US008820346B2

(12) United States Patent
Corbett

(10) Patent No.: US 8,820,346 B2
(45) Date of Patent: Sep. 2, 2014

(54) SELF-ACTUATING DRAINAGE DEVICE AND METHOD OF OPERATION

(76) Inventor: Thomas L. Corbett, Akron, OH (US)

( * ) Notice: Subject to any disclaimer, the term of this patent is extended or adjusted under 35 U.S.C. 154(b) by 181 days.

(21) Appl. No.: 13/403,228

(22) Filed: Feb. 23, 2012

(65) Prior Publication Data

US 2013/0220440 A1 Aug. 29, 2013

(51) Int. Cl.
*F04F 10/00* (2006.01)

(52) U.S. Cl.
USPC ..... 137/135; 137/143; 137/151; 137/397; 137/416; 251/65

(58) Field of Classification Search
USPC ..... 137/123–153, 397, 398, 416, 429, 430; 251/65
See application file for complete search history.

(56) References Cited

U.S. PATENT DOCUMENTS

| | | | | | |
|---|---|---|---|---|---|
| 301,391 | A * | 7/1884 | Reinecke | 137/135 |
| 688,942 | A * | 12/1901 | Engelhard | 4/355 |
| 814,208 | A * | 3/1906 | Hogan | 137/135 |
| 1,062,847 | A * | 5/1913 | Park | 137/398 |
| 1,096,788 | A * | 5/1914 | Madden | 137/134 |
| 2,862,517 | A * | 12/1958 | Kraft | 137/417 |
| 3,400,733 | A * | 9/1968 | Scoppola | 137/416 |
| 3,757,812 | A * | 9/1973 | Duncan | 137/142 |
| 4,059,126 | A * | 11/1977 | Nickerson | 137/142 |
| 4,168,717 | A * | 9/1979 | Rinker | 137/135 |
| 4,406,300 | A * | 9/1983 | Wilson | 137/132 |
| 4,513,768 | A * | 4/1985 | Sarver et al. | 137/142 |
| 5,179,969 | A * | 1/1993 | Peterson | 137/1 |
| 5,301,375 | A * | 4/1994 | Osmond | 4/368 |
| 5,343,888 | A * | 9/1994 | Stelzer | 137/135 |
| 5,381,956 | A * | 1/1995 | Robinson et al. | 239/22 |

* cited by examiner

*Primary Examiner* — John K Fristoe, Jr.
*Assistant Examiner* — Matthew W Jellett
(74) *Attorney, Agent, or Firm* — Renner Kenner Greive Bobak Taylor & Weber

(57) ABSTRACT

A self-actuating drainage device for placement on a structure to drain water accumulated on the structure includes a collection funnel having a bottom with a funnel hole extending therethrough, a siphon conduit contiguous with the funnel hole, the siphon conduit having a first end disposed on the structure and an opposite end disposed at a position lower than the first end. The device further includes a valve mechanism which includes a float maintained within the collection funnel. The valve mechanism opens when accumulated water raises the float so that the water collected in the collection funnel is released through the siphon conduit and starts a siphoning action from the first end to the opposite end when the valve mechanism closes.

17 Claims, 8 Drawing Sheets

SELF-ACTUATING DRAINAGE DEVICE AND METHOD OF OPERATION

TECHNICAL FIELD

Generally, the present invention is directed to a drainage device. Specifically, the invention is directed to a self-actuated roof drainage device and more particularly to a self-actuated siphon drainage device and a related method of operation.

BACKGROUND ART

Buildings are constructed to provide protection from weather elements such as wind, snow and rain. Smaller structures such as residential houses have inclined or angled rooftops so as to deflect the rain or melting snow. In other words, the rain or melting snow is easily directed by the inclined roof surface to gutters which collect the water and divert it away from the house. As a result, water damage to the house only occurs if the roof structure itself is damaged by wind or prolonged wear.

Larger structures such as school buildings, warehouses, factories and the like utilize flat roofs as they are easier to construct and much cheaper to build than structures which have inclined roofs. One significant drawback of a flat roof structure is that standing water accumulates on the surface. Due to expansion and contraction of the roof structure, based on temperature changes, openings and cracks develop in the structure. These changes sometimes take years to develop, but inevitably they do and lead to damage of the structure. This is especially true where standing water collects in areas of the cracking as the water seeps into the underlying structure causing rot, mildew, and other damage to the interior of the structure.

Solutions to the problem of standing water on flat-roof structures include manually squeegeeing water from the standing pool to the edge of the building or to a drain. Although this is somewhat effective, personnel walking on the roof structure can damage it thereby increasing the likelihood of cracks and further water damage. Electrically actuated pumps can be positioned onto the roof but this requires running electrical power to the devices, which may be dangerous as these devices are frequently left unattended. Battery powered pumps can also be used, but they require charging and maintenance.

Therefore, there is a need in the art for a self-actuated drainage device for flat roof structures. Indeed, there is a need for a device to collect rain water and start a valve/siphon mechanism to initiate a siphon operation to pull water away from the areas of standing water and where the mechanism continues to operate until the area of standing of water is significantly reduced or eliminated. There is also a need for such a device that needs only minimal oversight and maintenance.

SUMMARY OF THE INVENTION

In light of the foregoing, it is a first aspect of the present invention to provide a self-actuating drainage device and method of operation.

It is another aspect of the present invention to provide a self-actuating drainage device for placement on a structure to drain water accumulated on the structure, comprising a collection funnel having a bottom with a funnel hole extending therethrough, a siphon conduit contiguous with the funnel hole, the siphon conduit having a first end disposed on the structure and an opposite end disposed at a position lower than the first end, and a valve mechanism including a float maintained within the collection funnel, the valve mechanism opening when accumulated water raises the float so that the water collected in the collection funnel is released through the siphon conduit and starts a siphoning action from the first end to the opposite end when the valve mechanism closes.

BRIEF DESCRIPTION OF THE DRAWINGS

This and other features and advantages of the present invention will become better understood with regard to the following description, appended claims, and accompanying drawings wherein:

BEST MODE FOR CARRYING OUT THE INVENTION

Figure 1:
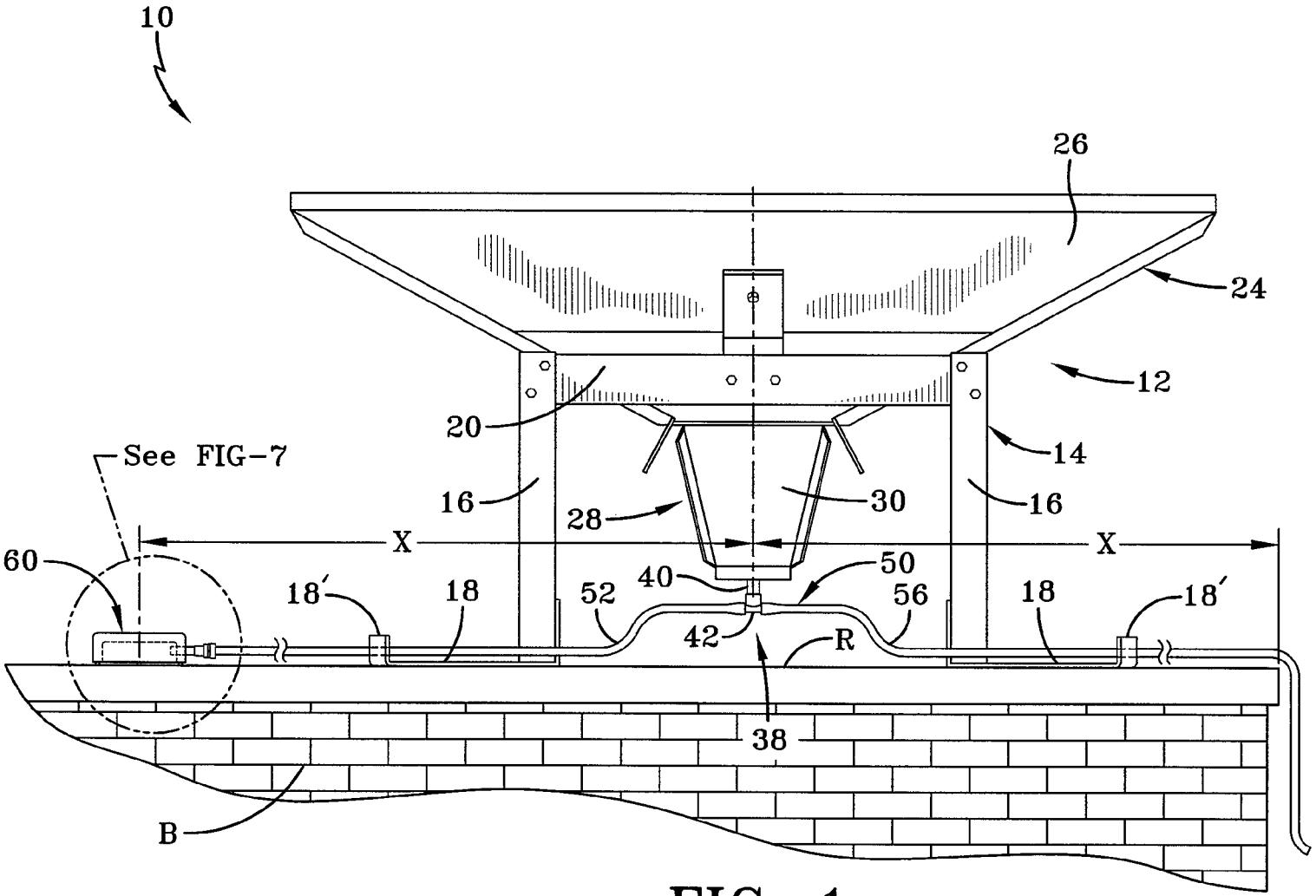
FIG. 1 is an elevational view of a self-actuating drainage device made in accordance with the concepts of the present invention.
Figure 2:
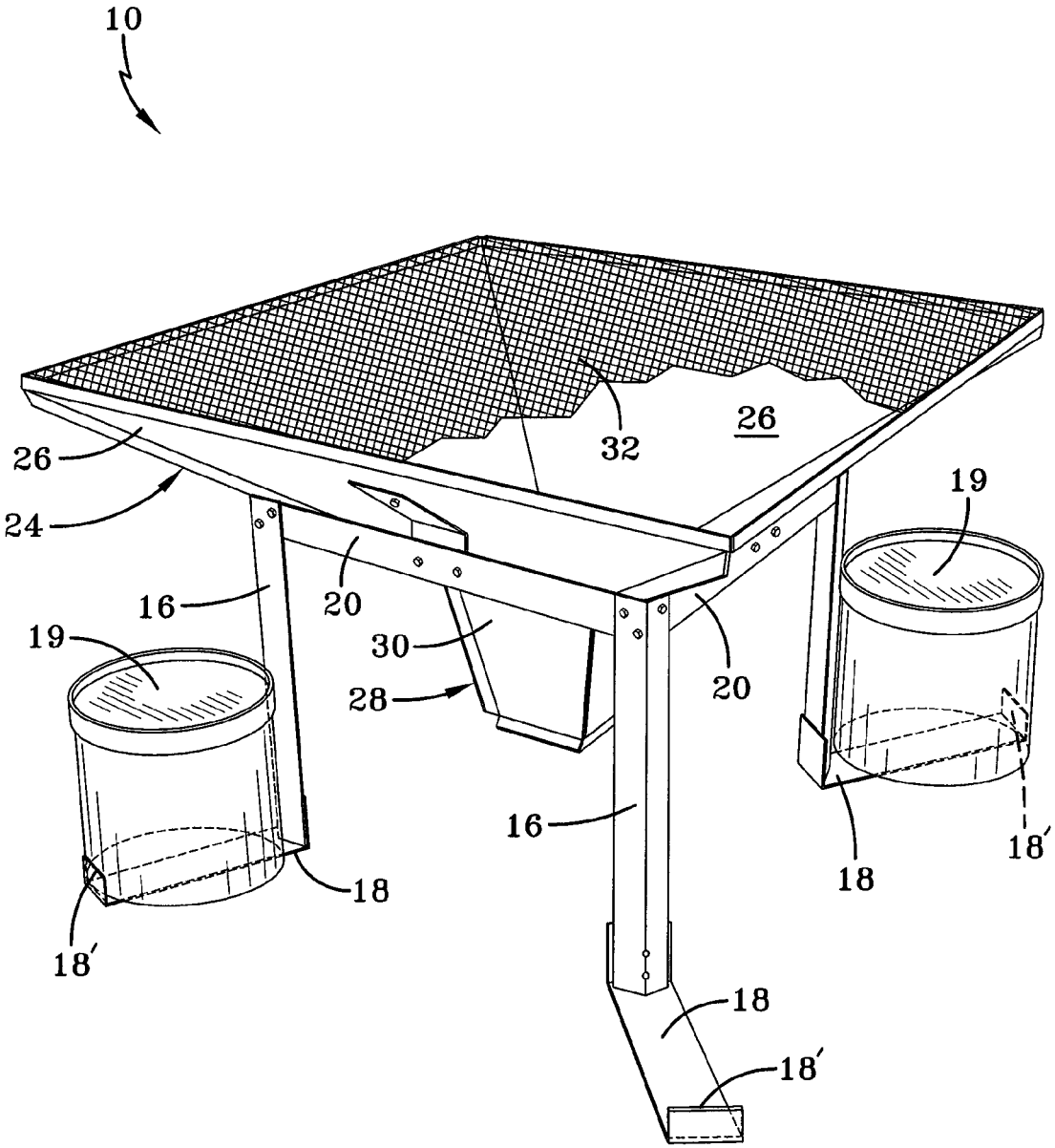
FIG. 2 is a perspective view of a collection funnel which is part of the self-actuating drainage device according to the concepts of the present invention.
Figure 3:
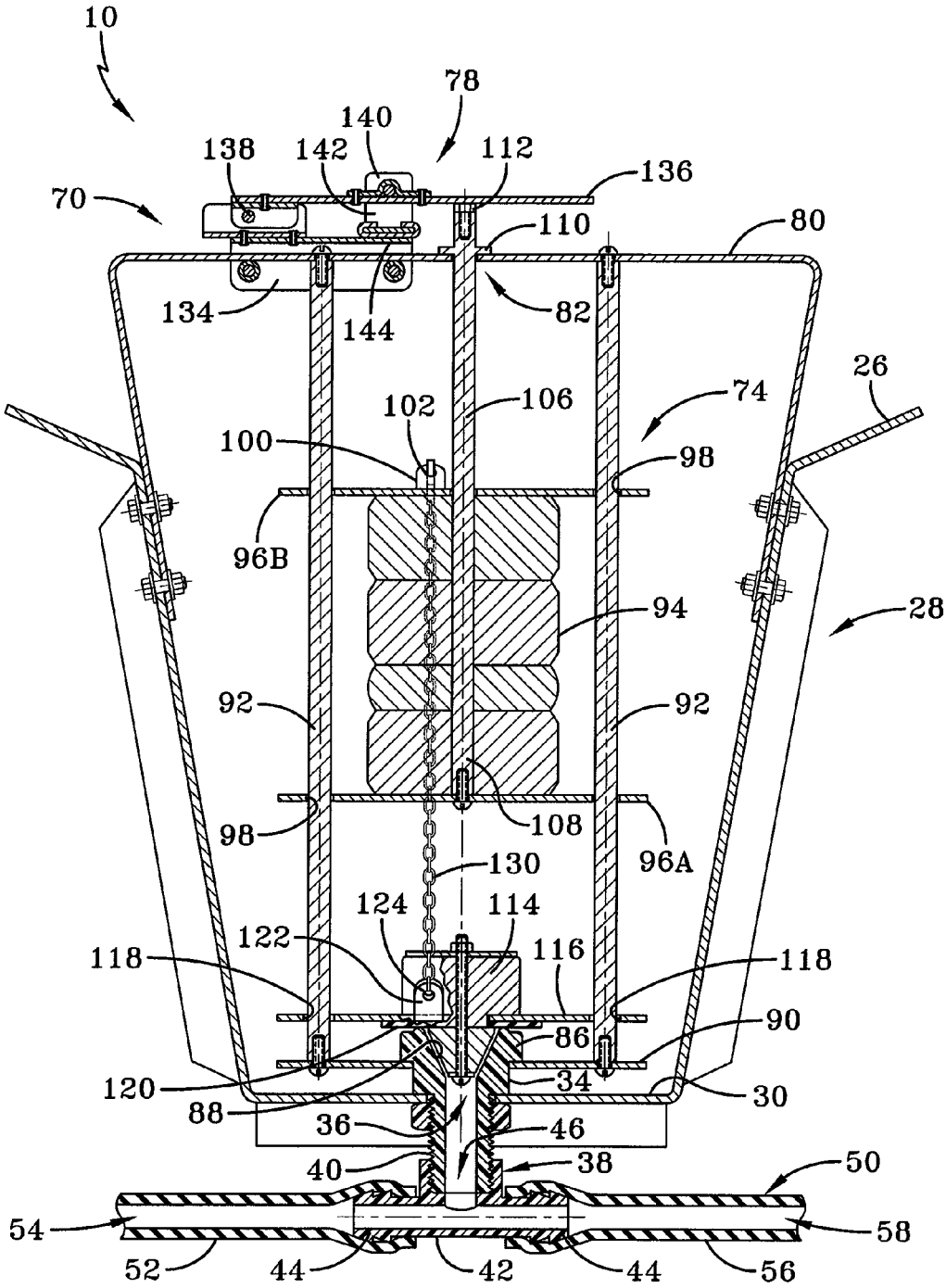
FIG. 3 is a detailed cross-sectional view of a lower chamber of the collection funnel specifically showing a valve mechanism made in accordance with the concepts of the present invention.

Referring now to the drawings and in particular to FIGS. 1-3, it can be seen that a self-actuating drainage device is designated generally by the numeral 10. The device 10 is typically positioned on a roof R that is of a flat construction associated with a structure or building B. The roof usually has areas where puddles form or standing water exists and does not drain after a rainstorm. It will be appreciated that the device 10 is typically used on flat-roof structures but that it could be utilized anywhere where standing water accumulates and needs to be drained provided that an area relatively lower than the level of the surface supporting the device 10 can be provided.

Referring specifically now to FIGS. 1 and 2, it can be seen that the device 10 includes a collection funnel 12 which collects rainwater for the purpose of actuating and operating the device 10. The funnel can be a conical-like shape and may be constructed of sheet metal, plastic or whatever material is appropriate for the environment where the device is situated. A funnel support 14 carries the collection funnel 12 and provides structural stability to the device. The support 14 includes a plurality of downwardly extending legs 16 each of which has a foot 18 that extends at substantially a right angle. The feet 18 are of extended length and extend outward toward the periphery of the collection funnel 12 and rest upon the roof or other supporting structure. The extended length of the feet 18, which may optionally include upwardly extending lips 18', provides stability to the device and also allow for weights 19 to be disposed thereon so as to prevent the device from being moved by high winds or the like. A typical weight may simply consist of a five-gallon bucket filled with water, sand, or other material. As part of the support 14, each leg 16 is connected at a top end by a brace 20 that surrounds an underside of the collection funnel 12.

The collection funnel 12 includes an upper chamber 24 formed by upper chamber walls 26. The upper chamber provides a wide surface area to collect as much rainfall or snow as possible. Associated beneath the upper chamber 24 and extending from a lower end of the upper chamber walls 26 is a lower chamber 28 formed by lower chamber walls 30. The lower chamber 28 concentrates the water collected by the upper chamber into a relatively small area so as to actuate the device 10 as will be discussed. Generally, the upper chamber and lower chamber 24, 28 may be of a trapezoidal-like configuration but other embodiments may utilize different shapes as deemed appropriate. A screen 32 may be disposed over a top surface of the upper chamber 24 for the purpose of allowing water to flow through but keeping debris such as leaves, sticks and other matter from entering the chambers.

As best seen in FIG. 3, a funnel conduit 34 is coupled or connected to a bottom end of the lower chamber 28 and provides a funnel hole 36 which extends through a bottom surface of the lower chamber walls 30. It will be appreciated that the chamber walls 30 include a bottom surface and extending side members which are typically angularly directed so as to concentrate the collected water toward the bottom of the chamber. In any event, the funnel hole 36 carries an inverted T-valve 38. The T-valve includes a stem 40 which is open to the lower chamber and a cross piece 42 which extends from an end of the stem 40 opposite the end of the stem positioned within the lower chamber. The cross piece 42 has opposed conduit ends 44. The stem 40 and cross piece 42 form a T-valve passage 46 which allows water collected in the lower chamber to flow through and exit out the conduit ends as will be described. Connected to the conduit ends 44 is a siphon conduit designated generally by the numeral 50. The siphon conduit 50 comprises at least two conduits and specifically a collection conduit 52 connected to one conduit end 44 wherein the collection conduit provides a passage 54. Connected to the other conduit end 44 is a drainage conduit 56 which also provides a corresponding passage 58. The conduits 52,56 are positioned such that the collection conduit remains on the flat structure while the drainage conduit is supported by the structure but has its opposite end at a relatively lower elevation than the collection conduit.

As shown in FIG. 1, an end of the drainage conduit 56 is placed over the edge of the roof so that the end is lower than the siphon conduit. In most embodiments the end of the drainage conduit will be inserted into a downspout, gutter or other drainage port. As seen in FIG. 1, and specifically shown in FIG. 7, a collection hub 60 is connected to a distal end of the collection conduit 52. As will be described in detail later, the collection hub is typically placed in an area where standing water accumulates after all other water on the flat structure is drained or evaporated.

The collection conduit 52 and the drainage conduit 56 are typically of the same cross sectional area and may have in one embodiment substantially the same length. This is done to ensure that the siphoning action to be later described is fully operational. However, in certain applications it will be appreciated that the lengths of the conduits may be adjusted as well as their corresponding cross-sectional areas. In other words, the lengths and cross-sectional areas of the conduits may be adjusted so as to ensure a particular mode of operation of the drainage device. For example, in some embodiments, a number of collection conduits could be used if their collective cross-sectional areas and lengths are selected to match and work with the cross-sectional area and length of the drainage conduit 56. In other embodiments, the collection conduit is shorter than the drainage conduit.

Referring now to FIGS. 3-6, a detailed discussion of the operation of the device 10 will be provided. As best seen in FIG. 3, a valve mechanism designated generally by the numeral 70 is carried by the lower chamber 28 for the purpose of collecting water and initiating a siphoning action so as to drain water from the flat roof structure. The valve mechanism 70 includes a guided float and stopper mechanism designated generally by the number 74 and a float bias mechanism designated generally by the numeral 78. Together, the mechanisms 74 and 78 initiate operation of the valve mechanism and terminate operation thereof at the appropriate time.

A support bracket 80 carries both the guided float and stopper mechanism 74 and the float bias mechanism 78 by the lower chamber 28. In particular, the support bracket, which is a relatively thin strip of material that allows the collected water to flow around, has opposed ends wherein each end is secured to a selected portion of the lower chamber walls 30 or associated structure.

A portion of the support bracket 80 has a stem hole 82 extending therethrough. A valve fitting 86 is located at the bottom of the lower chamber and connects to the inverted T-valve 38. The valve fitting 86 has a bore 88 extending therethrough and is contiguous with the T-valve passage 46. The bore 88 has a generally conical shape at an upper end so as to provide an appropriate guide and/or sealing surface for other components of the valve mechanism 70.

Figure 4:
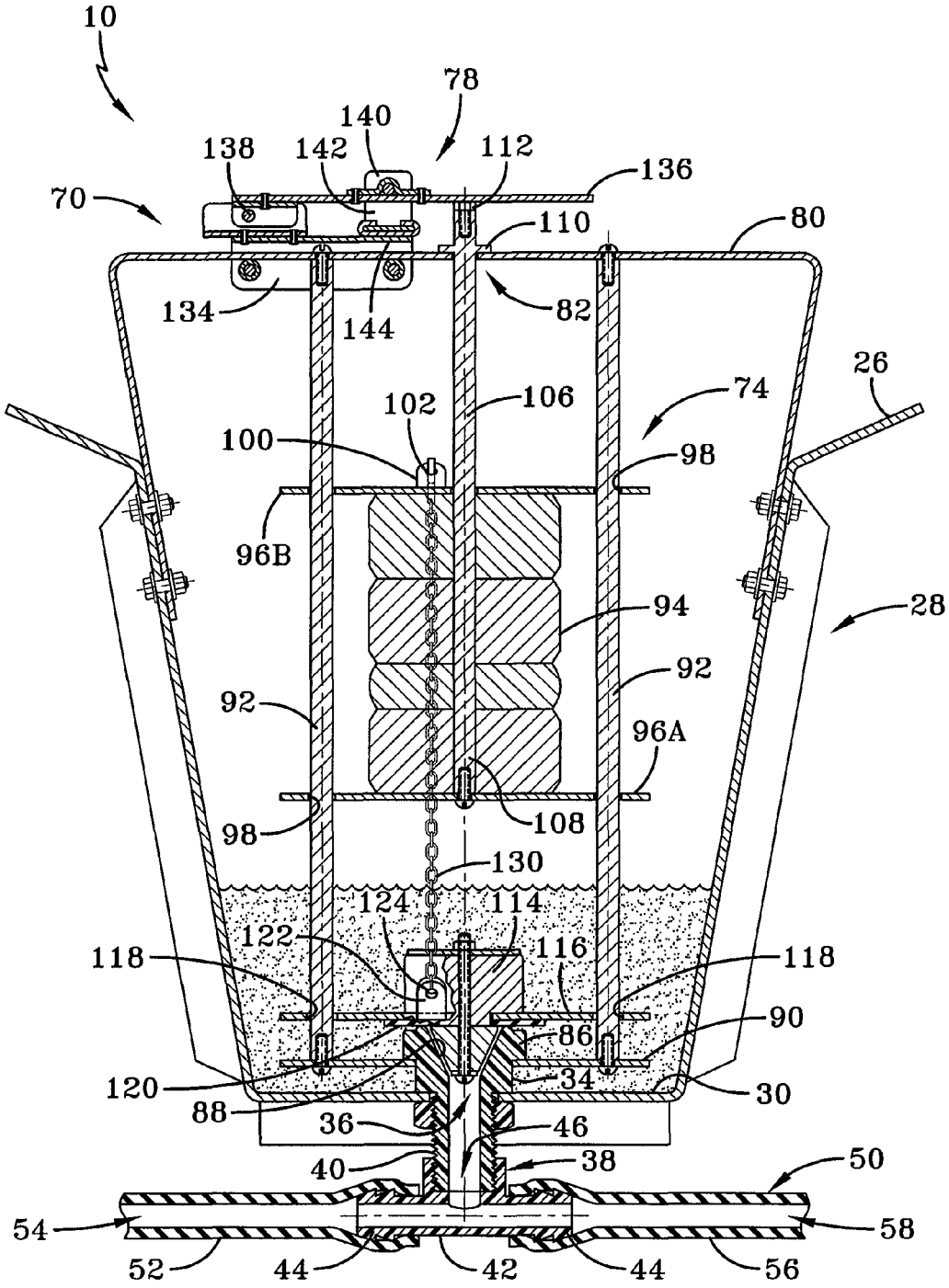
FIG. 4 is a cross-sectional view substantially the same as shown in FIG. 3 but showing water collected in the lower chamber.
Figure 5:
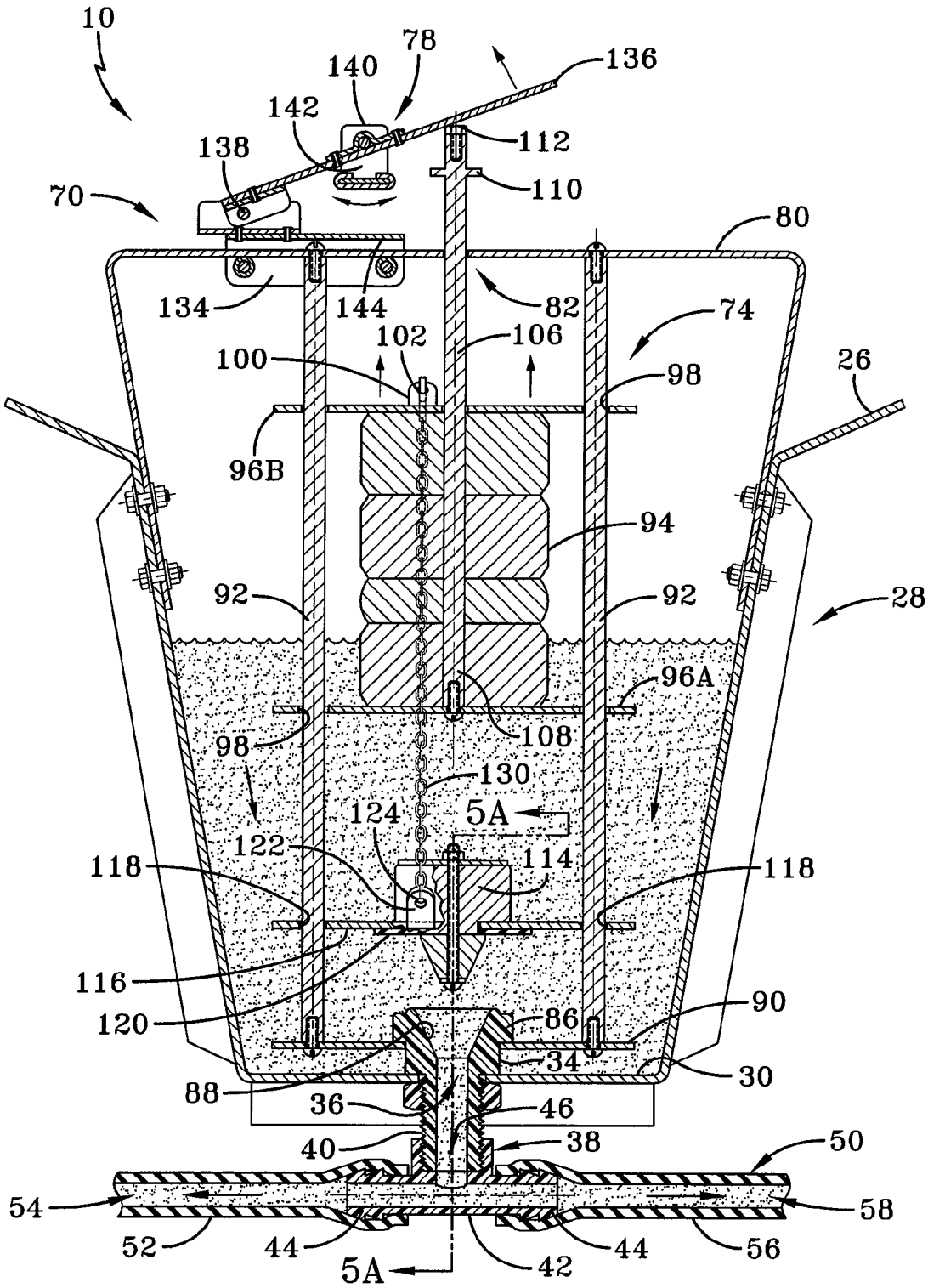
FIG. 5 is a cross-sectional view substantially the same as shown in FIG. 4 but showing the water level causing the valve mechanism to open.

The guided float and stopper mechanism 74 includes a base plate 90 which is secured around the valve fitting 86. A pair of rods 92 extend upwardly from the base plate 90 wherein the distal ends of the rods are secured to the support bracket 80. Although two rods are shown it will be appreciated that any number of rods could be utilized as will become apparent as the description proceeds. A float 94 is constructed of a buoyant material that naturally floats with the level of water contained within the lower chamber. Disposed at a bottom end of the float 94 is a float guide plate 96A wherein a corresponding guide float plate 96B is connected to a top end of the float 94. Each guide plate 96 has a pair of plate holes 98 which correspond to the number of rods 92. The plate holes 98 are sized to have a diameter slightly larger than the diameter of the rods 92 so as to allow for slidable movement of the float 94 along the length of the rods. A float tab 100 extends from the top guide plate 96B and the tab 100 has a tab hole 102 extending therethrough. Centrally disposed and extending axially from the float 94 is a float stem 106. One end of the float stem 106 is attached to the lower float guide plate 96 while the upper end of the float stem extends through the stem hole 82. In particular, the stem 106 has plate end 108 connected to the lower guide plate 96A and a stem flange 110 at an opposite end of the stem 106. The stem flange 110 is sized to be larger than the stem hole 82 so as to retain the stem in a position with respect to the support bracket 80. In other words, the float 94 is positionally maintained in the lower chamber according to the length of the float stem 106 between the end 108 and the flange 110. As such, the float 94 can extend down to only a positional length between the stem flange 110 and the end of the lower guide plate 96. Skilled artisans will appreciate that the length of the float stem may extend from the upper guide plate to the stem flange 110 but that the dimensional configuration of the float 94 would remain the same. It will further be appreciated that the float stem 106 has a lever end 112 that extends beyond the stem flange 110. From the foregoing description, it will be appreciated that as the water level rises and falls, the float 94 and the float stem 106 move in a corresponding manner. In other words, as the water level rises, as shown in FIG. 4, to come in contact with and surround the float 94, the stem 106 rises and in particular the lever end 112 rises above the support bracket 80 as shown in FIG. 5.

The guided float end stopper mechanism 74 also includes a stopper 114. The stopper includes a flexible stopper guide flange 116 positioned at an underside of the stopper 114. The flange 116 includes a plurality of flange holes 118 that are aligned with and receive the rods 92 so as to allow for slidable movement of the stopper along the length of the rods. The stopper provides a seal 120 on an underside of the stop guide flange 116, wherein the seal 120 fits in and closes the funnel hole 36. In other words, the seal 120 and the flange 116 close the opening between the lower chamber 28 and the T-valve passage 46. A stopper tab 122 extends from the bottom edge of the stopper guide flange 116 and has a tab hole 124 extending therethrough. The stopper 114 is connected to the float 94 by a link 130 that connects the stopper tab 122 to the float tab 100. As the float 94 moves upwardly based upon the amount of water collected in the lower chamber, the link 130 exerts a corresponding upward force on the flange 116. Further details as to the inter-relationship between the float 94 and the stopper 114 will be discussed as the description proceeds.

The float bias mechanism 78 is secured to the bracket 80. In particular, the mechanism 78 includes an attachment bracket 134 that is secured to the support bracket 80 by fasteners or welding or any appropriate means. If desired, the bracket 134 may be slidably adjusted to a desired position and then releasably secured to the bracket 80. The bias mechanism 78 further includes a lever arm 136 which is pivotally moveable with respect to the attachment bracket by a pivot pin 138. A lever arm adjustment 140 is disposed along the length of the lever arm 136 wherein a lever arm magnet 142 is attached thereto. A bracket magnet 144 is positionally maintained along the attachment bracket 134 and is normally attracted to the magnet 142. The magnet 142 may be pivotable and slidably adjusted with respect to the arm 136 to facilitate re-engagement with the magnet 144. If desired, the magnets 142 and 144 can be positionally adjusted so as to adjust the amount of force required by the stem 106 and the float 94 to move the lever arm 136 with respect to the pivot pin 138. The magnets 142, 144 are utilized to restrain movement of the lever arm as will be described.

Figure 7:
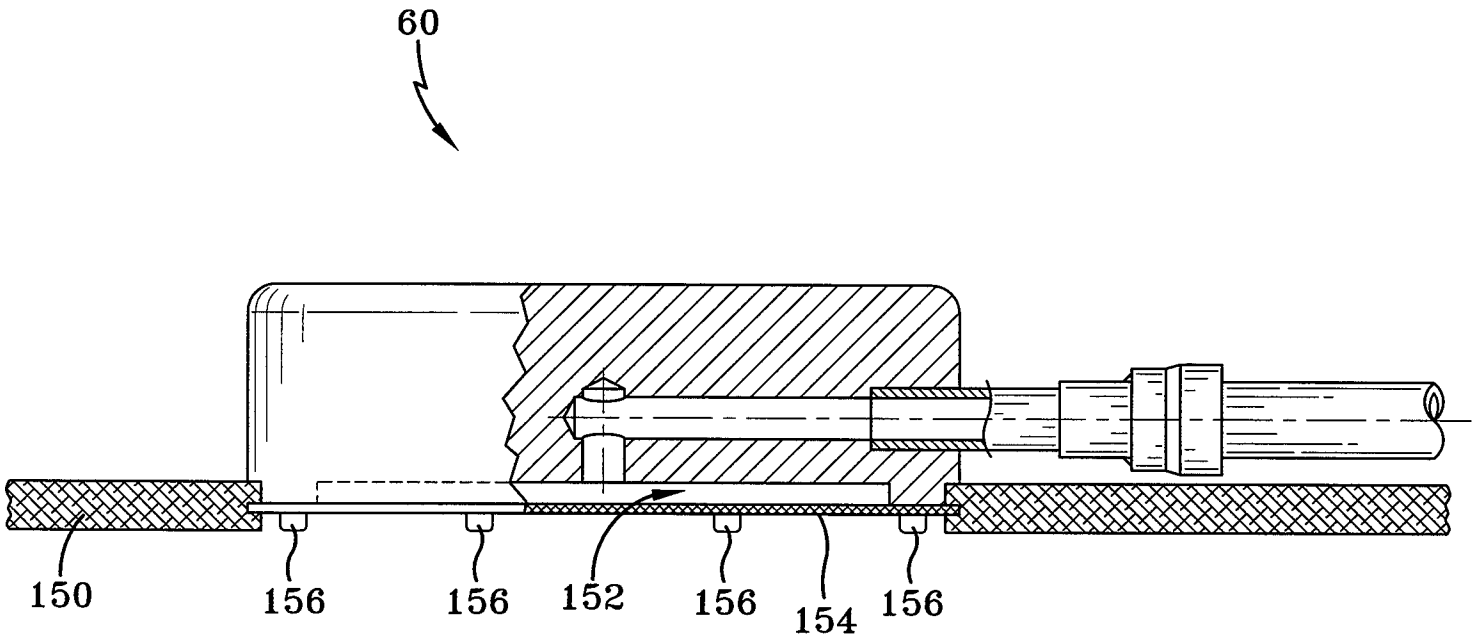
FIG. 7 is an elevational view of a collection hub connected to a siphon conduit that is associated with the valve mechanism according to the concepts of the present inventions.

Referring now to FIG. 7, it can be seen that the collection hub 60 is connected to an end of the collection conduit 52. The hub 60 may have disposed about the periphery thereof a major filter screen 150 which is porous enough to allow water to flow therethrough but which prevents debris from entering into the collection hub and the collection conduit. The hub 60 forms a cavity 152 which is contiguous with the conduit passage, and wherein a hub screen 154 may be disposed over the hub cavity to further preclude debris from entering the conduit passage. A plurality of standoff pads or ribs 156 extend from an underside periphery of the collection hub so as to allow water to flow into the hub cavity and through the collection conduit.

Referring back to FIGS. 3-6, the operation of the device 10 will now be described. As seen in FIG. 3, no water has entered the collection chamber 28 and the stopper 114 and the seal 120 are seated in the valve fitting 86. The float bias mechanism 78 is in a closed position and as such the lever arm 136 rests upon the lever end 112 with the stem flange 110 supported by the support bracket 80. This maintains the float 94 in a predetermined position and the float 94 is linked to the stopper 114 by the link 130. Skilled artisans will appreciate that the link 130 is sized so as to have a predetermined amount of slack, but it will be appreciated that as the float 94 moves upwardly, a corresponding movement will also be exerted on the stopper 114 once the slack in the link is taken up.

Referring now to FIG. 4, it can be seen that water has begun to fill the lower chamber but has not yet reached a lower end of the float 94. The stopper 114 is constructed of a material that is not buoyant or which may provide a minimal amount of buoyancy as will be described. In any event, the water continues to fill the lower chamber until such time as it engages the float 94.

Figure 5A:
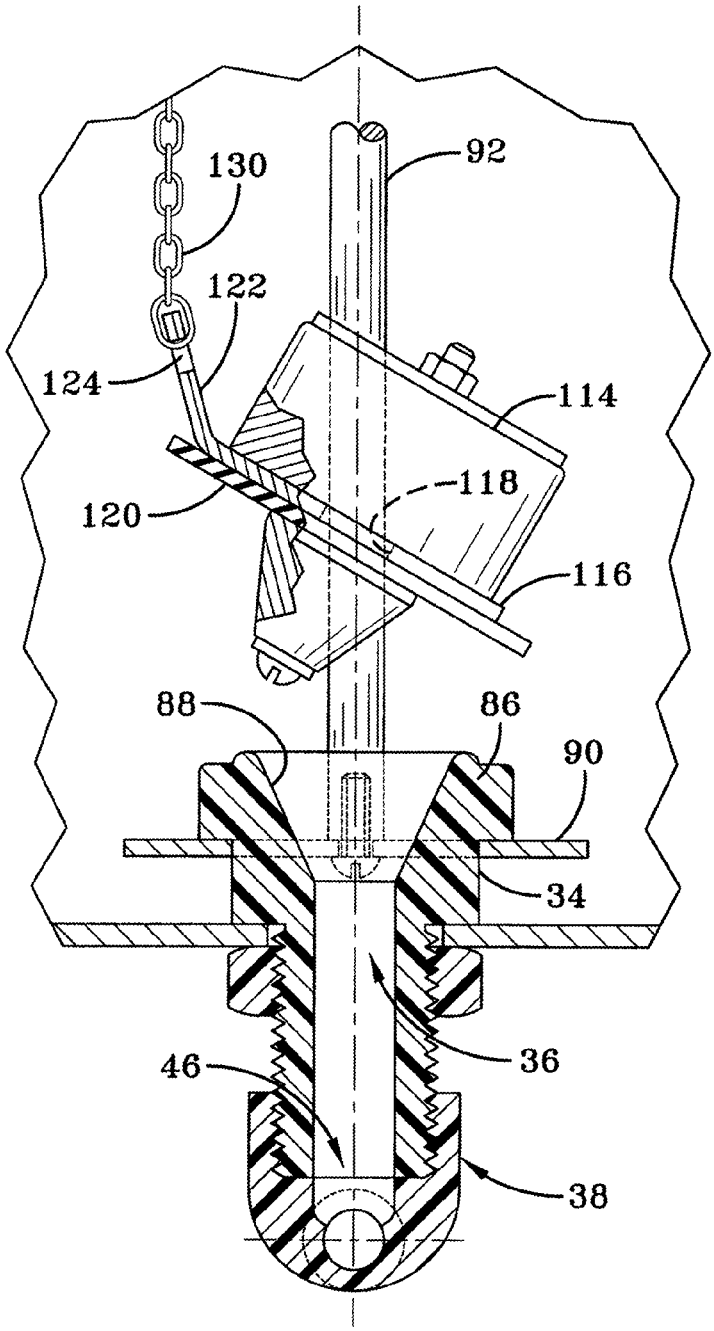
FIG. 5A is a side elevational view of the valve mechanism taken along lines 5A-5A of FIG. 5.

As the water level rises, as seen in FIG. 5, the water moves the float 94 upwardly such that the guide plates 96 move along the rods 92. This upward motion of the float 94 causes the stem 106 and in particular the stem end 112 to force apart and disengage the magnets 142,144 from one another and pivot the lever arm 136 upwardly. It will be appreciated that movement of the lever arm is biased or restrained by inclusion of the magnets 142 and 144. Accordingly, the lever arm will not move upwardly until sufficient force is exerted by the water on the float 94 so as to move the float upwardly and to also overcome the magnetic forces exerted on the lever arm. Skilled artisans will appreciate that other biasing mechanisms such as springs or the like could be utilized to ensure that an adequate "break-away" force is required to move the float 94. One advantage of utilizing a magnetic force is that the break-away force is somewhat instantaneous so as to ensure a complete and sudden movement of the float 94 which in turn causes the stopper 114 to make a sudden movement and begin moving away from the valve fitting 86 as shown in FIG. 5A. By connecting the link 130 to an edge of the flexible flange 116, the seal between the flange 116 and the valve fitting 86 is more easily broken to allow draining of the water to begin and assist in forcing the stopper away from the valve fitting to maintain a consistent flow out of the chamber once the seal is broken.

Figure 6:
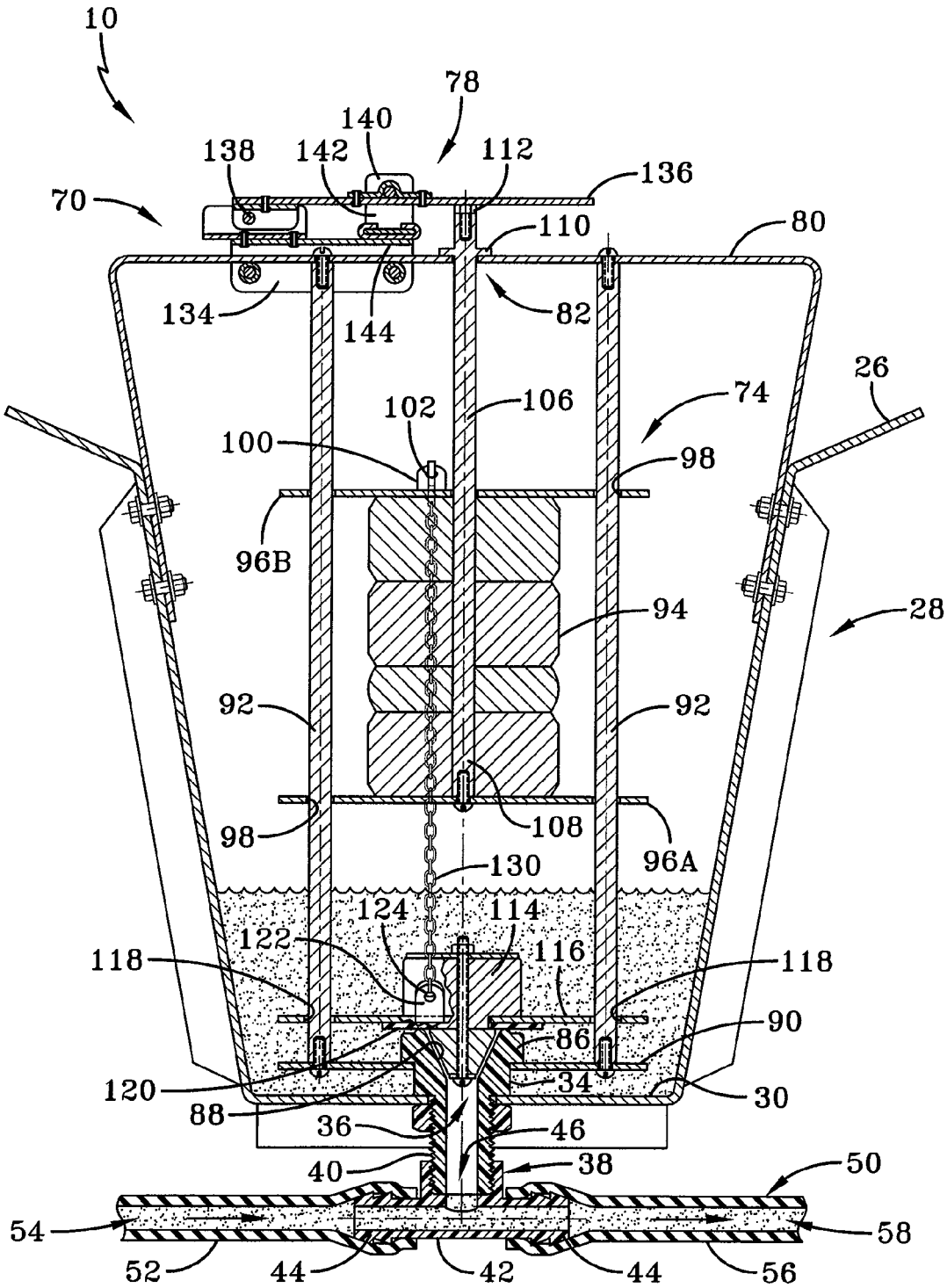
FIG. 6 is a cross-sectional view substantially the same as shown in FIG. 5 but wherein the valve is shown in a closed position with a siphoning action initiated.

Once the water forces are adequate to move the stopper to an open position, water collected within the lower chamber exits through the inverted-T-valve, splits and proceeds out the collection conduit 52 and the drainage conduit 56. The draining action continues until the water level is fully depleted from the lower chamber. As this occurs, the float lowers, the magnets re-engage one another, and the stopper 114 returns to its seated position with respect to the valve fitting 86 so as to prevent any further passage of water from the lower chamber into the siphon conduit. Once the seal is reformed between the stopper and the valve fitting, the water contained within the inverted T-valve 38 continues out the conduits until such time that water no longer has enough hydraulic force to be expelled from the collection conduit at the collection hub. However, the water exiting the drainage conduit continues to flow and exerts a pulling force and as such, a siphon is generated between the end of the drainage conduit and the collection hub as represented in FIG. 6 would continue to cycle. Accordingly, the siphon force acts upon the water associated near the collection hub and continues to act as long as rain or water accumulates around the hub.

In the event the rainfall continues for an extended period of time and the lower chamber fills again with water, then the float 94 moves upwardly and the collected water runs out the drainage conduit as part of the siphoning action. Once the collected water is drained, the stopper 114 closes the passage 46 as previously described.

As the rainfall ends, any water accumulated in the area around the collection hub is siphoned off through the drainage conduit into a drainage area as appropriate. This drainage or siphoning action will continue until the water no longer pools around the collection hub.

It will be appreciated that certain variations may be provided with the device 10. In particular, multiple siphon conduits may be provided wherein several collection hubs may emanate from the inverted-T or where multiple inverted T-fittings may be provided. In such embodiments, certain adjustments will need to be made to the length of the siphon conduit and the cross sectional areas of the conduit so as to allow for multiple hub operation.

The advantages of the device 10 are readily apparent. The device allows for self-operating functions which require minimal maintenance from technicians. In other words, the device 10 can be positioned on a flat roof structure in areas where it is known that significant puddles or standing water occurs. The device 10 can be left in place and operates without monitoring from the personnel installing the device. If needed, the devices can be moved to various locations so as to remove the standing water from selected areas by manually filling the chamber with water. Operation of the device does not require electric motors or the like and as such all the maintenance required for such a device is eliminated. By easily removing standing water, water exposure to the roof structure and potential freezing and thawing of the water during winter months is eliminated. This reduces the amount of structural damage to the roof and prevents rainfall from further damaging the structure from normal accumulation or from accumulation of ice during winter months. Another advantage of the device is the use of the break-away feature of the lever arm either alone or in combination with the edge link connection. This feature prevents repeated opening and closing of the inverted T-valve which would hinder the siphon action of the device.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A self-actuating drainage device for placement on a structure to drain water accumulated on the structure, comprising:

a collection funnel having a bottom with a funnel hole extending therethrough;

a siphon conduit contiguous with said funnel hole, said siphon conduit having a collection conduit at one end disposed on the structure and a drainage conduit at least partially disposed on the structure with an opposite end of said drainage conduit disposed at a position lower than said collection conduit, wherein said collection conduit and said drainage conduit are maintained in substantially the same planar orientation with one another; and a valve mechanism comprising a stopper positionable in said funnel hole, a float maintained within said collection funnel, a link connecting said float to said stopper, a stem extending from said float, a support bracket having a stem hole therethrough that slidably receives said stem, a float bias mechanism secured to said support bracket and having a pivotable lever arm movable by said stem, said pivotable lever arm biased by a magnet, wherein said valve mechanism opens when accumulated water raises said float and said stem so as to overcome a biasing force exerted by said magnet on said stem so that the water collected in said collection funnel is released through both said collection and drainage conduits and starts a siphoning action from said collection conduit to said opposite end of said drainage conduit.

2. The device according to claim 1, wherein said float is movable with respect to said stopper, said float and said link moving said stopper away from said funnel hole when the accumulated water in said collection funnel exceeds a length of said link and the biasing force is overcome.

3. The device according to claim 2, wherein said float bias mechanism maintains said float and in turn said stopper in a closed position even if the water collected in said collection funnel would otherwise raise said float.

4. The device according to claim 3, wherein said valve mechanism further comprises:

at least one rod extending either from said support bracket or said collection funnel, said float having a guide plate with a plate hole therethrough that slidably receives said at least one rod.

5. The device according to claim 1, wherein said magnet is movable along said lever arm to adjust a biasing force of said float bias mechanism.

6. The device according to claim 2, wherein said collection funnel comprises:

an upper chamber; and a lower chamber associated with said upper chamber, said valve mechanism primarily situated in said lower chamber.

7. The device according to claim 6, wherein said lower chamber concentrates water received into the collection funnel.

8. The device according to claim 7, further comprising:

a screen positioned over said upper chamber.

9. The device according to claim 2, further comprising:

a collection hub connected to said opposite end at said siphon conduit and adapted to be positioned in relatively low lying areas of the structure to drain water accumulated on the structure.

10. The device according to claim 2, further comprising:

a support structure having a plurality of legs supporting said support structure, each said leg having a foot contacting the structure, said foot extending beyond a perimeter of said collection funnel and adapted to receive a weight.

11. A self-actuating drainage device for placement on a structure to drain water accumulated on the structure, comprising:

a collection funnel having a bottom with a funnel hole extending therethrough;

a stopper positionable in said funnel hole;

a siphon conduit contiguous with said funnel hole, said siphon conduit having a first end disposed on the structure and an opposite end disposed at a position lower than said first end;

a valve mechanism comprising a float maintained within said collection funnel and a link connecting said float to said stopper, said float and said link moving said stopper from said funnel hole when accumulated water raises said float so that the water collected in said collection funnel is released through said siphon conduit and starts a siphoning action from said first end to said opposite end; and a float bias mechanism comprising a magnet to maintain said float and in turn said stopper in a closed position even if the water collected in said collection funnel would otherwise raise said float, said magnet maintaining an instantaneous break-away force on said float, which is separate and apart from buoyancy forces exerted by said float, wherein said valve mechanism further comprises: a stem extending from said float, a support bracket having a stem hole therethrough that slidably receives said stem; and said float bias mechanism secured to said support bracket and having a pivotable lever arm movable by said stem, said pivotable lever arm biased by said magnet which generates said instantaneous break-away force.

12. The device according to claim 11, wherein said float is movable with respect to said stopper, said float and said link moving said stopper away from said funnel hole when the accumulated water in said collection funnel exceeds a length of said link and said instantaneous break-away force is overcome.

13. The device according to claim 12, wherein said valve mechanism further comprises:

said support bracket carried by said collection funnel;

at least one rod extending either from said support bracket or said collection funnel, said float having a guide plate with a plate hole therethrough that slidably receives said at least one rod.

14. The device according to claim 12, wherein said magnet is movable along said lever arm to adjust a biasing force of said float bias mechanism.

15. The device according to claim 12, wherein said collection funnel comprises:

an upper chamber; and a lower chamber associated with said upper chamber, said valve mechanism primarily situated in said lower chamber.

16. The device according to claim 12, further comprising:

a collection hub connected to said opposite end at said siphon conduit and adapted to be positioned in relatively low lying areas of the structure to drain water accumulated on the structure.

17. The device according to claim 12, further comprising:

a support structure having a plurality of legs supporting said support structure, each said leg having a foot contacting the structure, said foot extending beyond a perimeter of said collection funnel and adapted to receive a weight.

* * * * *